US005370208A

United States Patent [19]

De Jong

[11] Patent Number: 5,370,208

[45] Date of Patent: Dec. 6, 1994

[54] DOUBLE-SIDED SAFETY GEAR

[75] Inventor: Johannes De Jong, Järvenpää, Finland

[73] Assignee: Kone Elevator GmbH, Baar, Switzerland

[21] Appl. No.: 234,603

[22] Filed: Apr. 28, 1994

Related U.S. Application Data

[63] Continuation of Ser. No. 977,828, Nov. 17, 1992, abandoned.

[30] Foreign Application Priority Data

Nov. 18, 1991 [FI] Finland ..... 915429

[51] Int. Cl.[5] ..... B66B 5/16

[52] U.S. Cl. ..... 187/372; 188/72.2; 187/376

[58] Field of Search ..... 187/88, 89, 90; 188/188, 189, 72.2

[56] References Cited

U.S. PATENT DOCUMENTS

| | | | |
|---|---|---|---|
| 3,762,512 | 10/1973 | McIntyre | 187/88 |
| 4,819,765 | 4/1989 | Winkler et al. | 187/88 |

FOREIGN PATENT DOCUMENTS

| | | | |
|---|---|---|---|
| 297260 | 3/1972 | Austria . | |
| 74686 | 11/1987 | Finland . | |
| 444754 | 5/1927 | Germany . | |
| 1215322 | 4/1966 | Germany . | |
| 3715098 | 11/1990 | Germany . | |
| 236904 | 11/1925 | United Kingdom | 187/88 |
| 2190356 | 11/1987 | United Kingdom . | |
| 931641 | 5/1982 | U.S.S.R. . | |
| 1411260 | 7/1988 | U.S.S.R. | 187/88 |

*Primary Examiner*—Kenneth W. Noland

[57] ABSTRACT

A safety gear e.g. for an elevator car or counterweight, comprises at least one wedge chamber (8) and at least one working wedge (9) acting on an elevator guide rail (30) and activated by a transmission element. For each working wedge (9), the safety gear has at least one counter wedge (10) moving along guide surfaces (14 and 39) provided in the wedge chamber (8). The counter wedge (10) of a working wedge (9) is on the same side of the guide rail as the working wedge (9) in question.

16 Claims, 2 Drawing Sheets

DOUBLE-SIDED SAFETY GEAR

This application is a continuation of application Ser. No. 07/977,828 filed on Nov. 17, 1992, now abandoned.

FIELD OF THE INVENTION

The present invention relates to a safety gear e.g. for an elevator car or counterweight, said safety gear comprising at least one wedge chamber and at least one working wedge acting upon a guide rail of the elevator and activated by means of a transmission element.

DESCRIPTION OF BACKGROUND ART

In elevators having a rated car speed exceeding 1 m/s, sliding safety gears are normally used as precautions when the elevator speed for some reason increases too much. The sliding safety gears grip the guide rails, of which there are usually two or four. In cases where each guide rail has its own sliding safety gear, the safety gears are mutually synchronized via separate synchronizing levers. The sliding safety gear is provided with a sliding surface which has a high friction coefficient and is pressed against the guide rail when the safety gear is activated, thus decelerating or stopping the elevator car by means of friction.

Various elevator safety gear structures have been developed. On of the most common is a large U-shaped spring made of spring steel, in which a wedge is thrust into the gap between the spring ends as it grips the guide rail. In addition, many safety gears have a separate release wedge by means of which the wedge is released from the guide rail after the safety gear action. The releasing is effected by raising the elevator car.

An example of the state of the art is also Finnish patent no. 74686, corresponding to German patent DE 3715098 and American U.S. Pat. No. 4,819,765. To stop the elevator car unit, both the car unit and the counterweight can be provided with safety gears e.g. as presented in patent 74686 and, to ensure safe operation in door zones, the overspeed governor can be provided with an electrically operated triggering device for switch-over to low speed. However, this is an expensive solution and takes up plenty of room because a safety gear is needed for the counterweight as well. In a sliding elevator safety gear according to this patent, standard parts are used and the wedge chamber is provided with a power means which imparts to the counter wedge a force acting substantially in the direction of the guide surface. The distance between the upper edges of the guide surfaces is equal to or greater than the distance between the lower edges of the corresponding guide surfaces. The force of the power means is generated by a spring. This patent does not accomplish compensation of the changes of friction on both sides but only on the side of the spring. Moreover, the clearances are relatively small.

In certain countries, the elevator regulations have been revised to prevent the occurrence of the following accidents:

An elevator car hits the ceiling of the elevator shaft after running up at an overspeed.

A passenger is crushed by the doorway structures of an elevator that has left a floor with doors open.

The new regulations also allow more freedom for the design of the safety equipment as they permit the use of non-mechanical solutions as well.

SUMMARY OF THE INVENTION

The double-sided safety gear of the invention is an improvement to the currently used safety gear, which was described above as an example of the state of the art. The object of the present invention is to eliminate the drawbacks mentioned. The safety gear of the invention has at least one counter wedge for each working wedge of the elevator, said counter wedge moving along a guide surface provided in the wedge chamber, and the counter wedge of the working wedge is on the same side of the guide rail as the working wedge in question.

The device of the invention has the advantages that the clearances are larger than in previously known solutions the variations in friction appearing on both sides of the guide rail can be eliminated, so the friction coefficient remains constant user safety is improved as well.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the safety gear of the invention is described in detail by referring to the drawings which are given by way of illustration only, and thus are not limitative of the present invention, and in which.

DETAILED DESCRIPTION OF THE PREFERRED EMBODIMENTS

Figure 1:
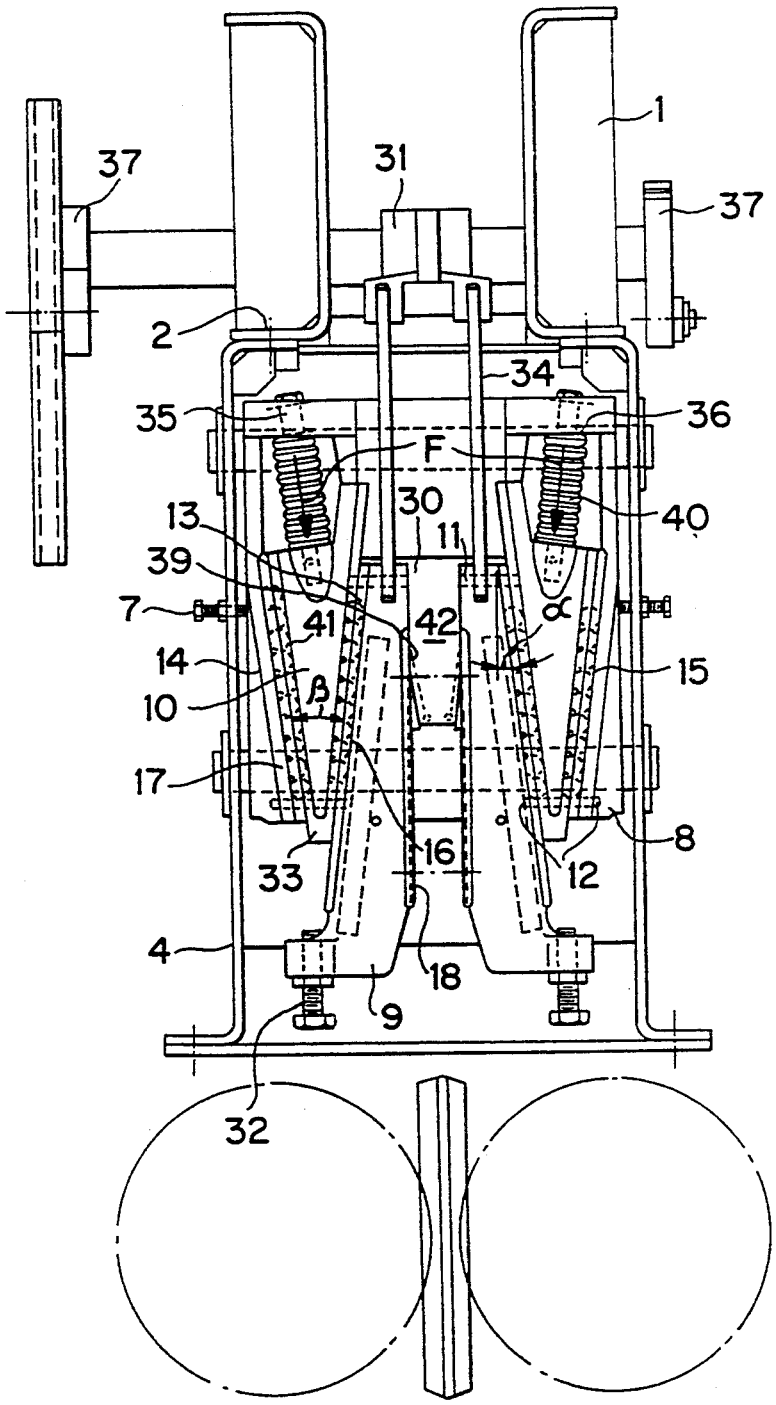
FIG. 1 shows the safety gear of the invention.
Figure 2:
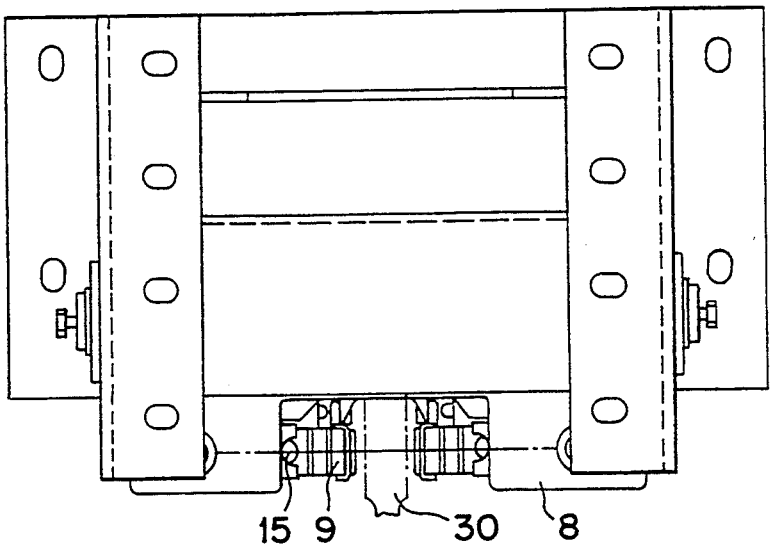
FIG. 2 shows the same safety gear in a top view.
Figure 3:
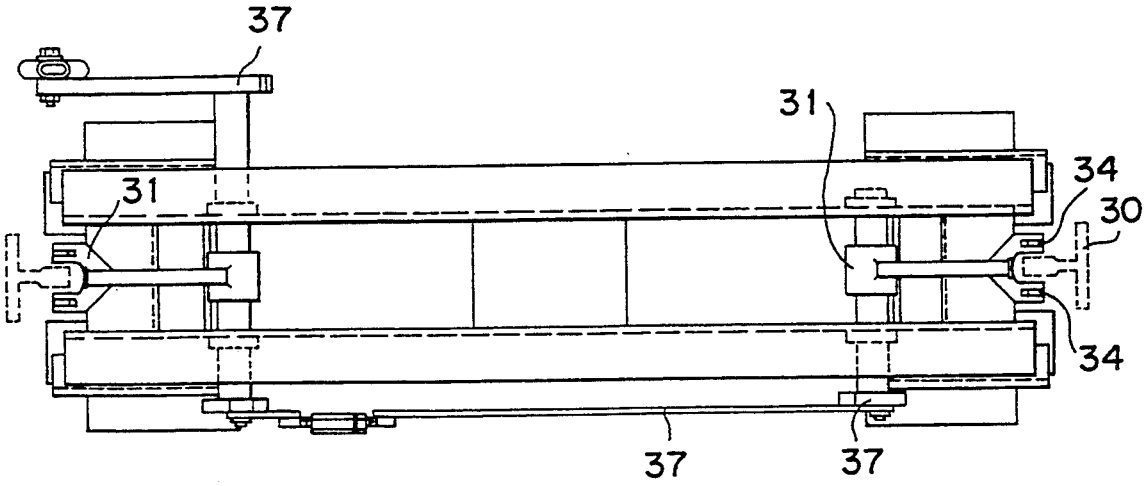
FIG. 3 shows the safety gear of the invention in top view, showing a lever system, a synchronizing fork and a guide rail.

The safety gear has a frame 4 which is fixed to the elevator car unit 1 by means of bolts 2. The frame is provided with a wedge chamber 8, which houses working wedges 9 placed on either side of the guide rail 30. The upper and lower ends of the working wedges 9 differ in width because of their wedge-like shape. For each working wedge 9 there is a counter wedge 10, which also has a wedge-like shape, and these two counter wedges 10 are placed on either side of the guide rail 30. For lateral adjustment of the wedge chamber 8, the safety gear is provided with adjusting screws 7 seated in the safety gear frame 4. The working wedges 9 are attached by their upper ends with synchronizing forks 31 via levers 37 to ropes or other lifting means. This safety gear can only grip during downward travel of the elevator car. The wedge chamber 8 is provided with guide surfaces 14 and 39, along which the counter wedge 10 moves so that the guide surfaces 14 and 39 are parallel to each other. The counter wedge 10 has a guide surface 13 provided with balls 15 on which the working wedge 9 moves. The distance of guide surface 13 from the guide rail 30 diminishes as you trace the guide surface by moving upwards along it, and, similarly, the distance of guide surface 15 from the guide rail 30 increases as you follow it in the upward direction.

Correspondingly, the counter wedge 10 moves along guide surface 14. The wedge chamber 8 is centered relative to the guide rail by means of screws 7. The friction between the guide surface of the wedge chamber and the counter wedge is reduced by means of balls 15, which convert the friction into rolling friction. To hold the balls 15 in place, the guide surfaces are provided with rolling slots 16. The guide surface between wedges 9 and 10 is provided with similar rolling slots 16. To ensure that the balls will not come out of their rolling slots, the wedge chamber is provided with retaining cotters 12 placed at the lower ends of the slots. At the upper ends the corresponding retaining cotters 11 are attached to the wedges 9. Balls 15 and 42 in slots 14 and 39 keep wedges 10 at the right distance from the wedge chamber. The rolling slots 17 and the guide pins 41 keep the wedges 9 at the right distance from the surface of the counter wedge 10. The vertical surface of the wedges 9 travelling along the elevator guide rail 30 are provided with separate braking surfaces 18 with friction characteristics that are better than those of the wedge material itself. The lower part of the working wedge 9 is provided with an adjusting screw 32, whose stop face is the bottom surface 33 of the counter wedge 10. Attached to the upper ends of the working wedges 9 are synchronizing rods 34, which are further attached to the synchronizing forks 31 and the levers 37. Between the wedge chamber 8 and the upper ends of the counter wedges 10 are pressure springs 40 which push the counter wedges 10 obliquely downwards. The pressure springs 40 are attached to the counter wedges 10 by retention screws 35. The stop faces 36 of the pressure springs 40 in the wedge chamber 8 are so inclined as to direct the spring force applied to the counter wedges 10 so that it will act in a direction parallel to guide surfaces 14 and 39. Furthermore, the wedge chamber 8 is provided with protecting plates 38 to prevent the wedges from moving sideways out of the wedge chamber 8. At the same time, they protect the wedge chamber 8 againgst dirt and rubbish.

Below is a brief description of the operation of the safety gear of the invention. When the speed of the elevator car during downward travel increases too much, the overspeed governor (not shown in the figure) is activated, causing the working wedges 9 of the safety gear to rise. The working wedges 9 act simultaneously in the same direction. As the elevator car and, along with it, the wedge chamber 8 travel downwards in relation to the wedges 9, the braking surfaces 18 of the working wedges 9 engage the elevator guide rail 30 and the working wedges 9 continue moving upwards in relation to the wedge chamber 8. The relative upward motion of the working wedge 9 in relation to the wedge chamber 8 also causes the counter wedges 10 to move upwards against the springs 40. The upward motion of the counter wedge 10 is less than that of the working wedge 9 because the total angle $\beta$ of the counter wedge 10, i.e. the angle between surfaces 13 and 14, is larger than the angle $\alpha$ of the working wedge 9. This angle is the angle between surface 13 and the vertical direction. The magnitude of the difference between the motions of the counter wedge 10 and the working wedge 9 depends on the angle between the guide surfaces 13 and 14. During this motion, the spring force of the spring 40 increases and also the friction between surface 18 and the guide rail 30 increases. The adjusting screw 32 hits the bottom 33 of the counter wedge 10, causing the upward motion to stop and the frictional force to remain constant. The motion stops because otherwise the counter wedge 10 would come clear of the guide surface 14, whereupon the normal force would disappear and so would the friction. The spring will then return the counter wedge 10 back against the guide surface 14. After the safety gear action, when the elevator is released by raising the car, a motion in the opposite direction occurs and the springs 40 push the wedges back into place. The safety gear is so constructed that the working wedges 9 touch the elevator guide rail 30 before the counter wedges 10 are stopped in their upper position. As the working wedges 9 rise due to friction towards the limit of their upper position, the counter wedge 10 is also pushed up due to friction against the spring force F. By virtue of the wedge action, the frictional force obtained with spring force F between the wedges and the elevator guide rail 30 is very large, allowing a high braking power to be achieved. Because of angle $\alpha$, only a small spring force is needed and therefore a sufficient gripping power is achieved with a small spring. In the future, when the regulations permit, the data indicating the need for safety gear action may be obtained e.g. from a tachometer monitoring the car motion. The wedges can be moved e.g. using electromagnets.

It is obvious to a person skilled in the art that different embodiments of the invention are not restricted to the examples described above, but that they may instead be varied within the scope of the following claims.

What is claimed is:

1. A safety gear for an elevator car or counterweight movable in a movement direction, the safety gear comprising at least one working wedge acting on an elevator guide rail and activated by a transmission element, the safety gear having for each working wedge at least one counter wedge moving along guide surfaces provided in the wedge chamber, and the counter wedge of the working wedge being on a same side of the guide rail as the working wedge, an angle ($\beta$) between the guide surface being provided in the wedge chamber to guide the counter wedge and the guide surface on the side facing the working wedge, an angle ($\alpha$) being provided between the movement direction and the working wedge surface facing the counter wedge, the angle ($\beta$) being greater than the angle ($\alpha$) so that movement of the counter wedge in the movement direction is less than that of the working wedge.

2. The safety gear according to claim 1, wherein two working wedges are provided, the two working wedges being placed on opposite sides of the guide rail and being generally symmetrical relative to the guide rail, the working wedges acting simultaneously during gripping.

3. The safety gear according to claim 1, further comprising an adjusting screw provided in the working wedge, during safety action, the adjusting screw hits a narrower bottom end of the counter wedge.

4. The safety gear according to claim 1, further comprising at least one pressure spring attached to the at least one counter wedge and to at least one stop face in the wedge chamber.

5. The safety gear according to claim 4, wherein a plurality of counter wedges are provided and wherein a plurality of pressure springs are provided, the pressure springs being attached by fixing screws to respective counter wedges, each counter wedge having at least one pressure spring attached thereto, the counter wedges each having a wider end and the springs being attached to the wider ends of the counter wedges.

6. The safety gear according to claim 5, wherein each of the springs has a longitudinal axis and wherein each of the plurality of counter wedges has only one pressure spring attached thereto, the counter wedges being movable in a direction generally parallel to the longitudinal axis of the pressure spring which is attached thereto.

7. The safety gear according to claim 6, wherein the longitudinal axis of each of the pressure springs is offset from the movement direction such that the longitudinal axes of the pressure springs are nonparallel and nonperpendicular to the movement direction.

8. The safety gear according to claim 1, further comprising a pressure spring for each of the at least one counter wedges, the pressure springs each having a longitudinal axis and the longitudinal axes of the pressure springs being offset from the movement direction, the longitudinal axes of the pressure springs being nonparallel and nonperpendicular to the movement direction.

9. A safety gear for an elevator car or counterweight movable in a movement direction, the safety gear comprising at least one wedge chamber, at least one working wedge engageable with an elevator guide rail, at least one counter wedge movable along guide surfaces provided in the wedge chamber and an adjusting screw provided on the working wedge, the counter wedge of the working wedge being on a same side of the guide rail as the working wedge, and each of the at least one counter wedges being linearly movable toward and away from the guide rail without arching movement, during safety action the adjusting screw moves in an engagement direction toward and into engagement with a narrower bottom end of the counter wedge whereafter the counter wedge is moved away from the guide rail in response to continued movement of the adjusting screw in the engagement direction, the working wedge disengaging from the guide rail when the counter wedge moves away from the guide rail.

10. The safety gear according to claim 9, wherein the elevator car or counterweight is movable in a movement direction, an angle ($\beta$) between the guide surface being provided in the wedge chamber to guide the counter wedge and the guide surface on a side facing the working wedge and an angle ($\alpha$) being provided between the movement direction and the working wedge surface facing the counter wedge, the angle ($\beta$) being greater than the angle ($\alpha$) so that movement of the counter wedge in the movement direction is less than that of the working wedge.

11. The safety gear according to claim 9, wherein two working wedges are provided, the two working wedges being placed on opposite sides of the guide rail and being generally symmetrical relative to the guide rail, the working wedges acting simultaneously during gripping.

12. The safety gear according to claim 9, further comprising at least one pressure spring and at least one stop face in the wedge chamber, the at least one pressure spring being attached between the counter wedge and the at least one stop face in the wedge chamber.

13. The safety gear according to claim 9, wherein a plurality of counter wedges are provided and wherein a plurality of pressure springs are provided, the pressure springs being attached by fixing screws to respective counter wedges, each counter wedge having at least one pressure spring attached thereto, the counter wedges each having a wider end and the springs being attached to the wide ends of the counter wedges.

14. The safety gear according to claim 13, wherein each of the pressure springs has a longitudinal axis, each of the counter wedges being linearly movable in a direction generally parallel to the longitudinal axis of the pressure spring which is attached thereto.

15. The safety gear according to claim 14, wherein the longitudinal axes of the pressure springs are offset from the movement direction, the longitudinal axes being nonparallel and nonperpendicular to the movement direction.

16. The safety gear according to claim 9, further comprising a pressure spring for each of the at least one counter wedges, the pressure springs each having a longitudinal axis and the longitudinal axes of the pressure springs being offset from the movement direction, the longitudinal axes of the pressure springs being nonparallel and nonperpendicular to the movement direction.

* * * * *